United States Patent [19]

Standring

[11] Patent Number: 4,863,109

[45] Date of Patent: Sep. 5, 1989

[54] RELATED TO GRINDING MILLS

[75] Inventor: Peter M. Standring, Nottingham, England

[73] Assignee: National Research Development Corporation, London, England

[21] Appl. No.: 258,838

[22] Filed: Oct. 12, 1988

Related U.S. Application Data

[63] Continuation-in-part of Ser. No. 930,370, Oct. 27, 1986.

[30] Foreign Application Priority Data

Feb. 26, 1985 [GB] United Kingdom ..... 8504901
Oct. 13, 1987 [GB] United Kingdom ..... 8424005

[51] Int. Cl.[4] ..... B02C 7/12

[52] U.S. Cl. ..... 241/198 R; 241/117; 241/257 R

[58] Field of Search ..... 241/109, 110, 117–122, 241/198 R, 199, 199.9, 220, 257, 258, 301, 123, 126

[56] References Cited

U.S. PATENT DOCUMENTS

| | | | |
|---|---|---|---|
| 617,030 | 1/1899 | Köneman | 241/121 X |
| 4,067,503 | 1/1978 | Broman | 241/117 |
| 4,606,506 | 8/1986 | Okada et al. | 241/121 X |
| 4,679,739 | 7/1987 | Hashimoto et al. | 241/121 |

FOREIGN PATENT DOCUMENTS 932472 9/1955 Fed. Rep. of Germany .

*Primary Examiner*—Timothy V. Eley
*Attorney, Agent, or Firm*—Cushman, Darby & Cushman

[57] ABSTRACT

An upper grinding conical shaped member rolls around a lower grinding surface, granular material to be ground being fed onto the grinding surface through a hole in the apex of the upper grinding member and being deflected into the path of the upper grinding member by a pip located at the center of the grinding surface.

7 Claims, 1 Drawing Sheet

RELATED TO GRINDING MILLS

The present invention relates to grinding mills and more particularly to mills for grinding granular material for example grain.

A known grinding mill for grinding granular material is described in our published U.S. Patent Application No. 930,370 and uses a conical grinding member which is mounted to rolled around a grinding surface.

It is an object of the present invention to provide an improved grinding mill using similar principles to the mill described in the above pending U.S. Application.

According to the present invention there is provided a mill for grinding granular material comprising:

a grinding surface;

a generally conical grinding member having a hollow therein;

a mounting arrangement for supporting the generally conical grinding member in such a manner that the grinding member can be precessed around the grinding surface, the mounting arrangement including feed means for introducing the granular material into the hollow of the grinding member, in which the apex of the generally conical grinding member is cut away to produce a hole through the grinding member connecting to the hollow therein, in which the grinding surface is provided with an upstanding pip positioned centrally, in which the mounting arrangement for supporting the generally conical grinding member comprises means for locating the generally conical grinding member in a defined position relative to the grinding surface in such a manner that the upstanding pip co-operates with the hole through the apex of the generally conical grinding member in such a manner as to partially block the hole and prevent the passage of the granular material through a first portion of the hole whilst allowing passage of the granular material through a second portion of the hole, in which the granular material passing through the second portion of the hole is deflected by the upstanding pip on the grinding surface outwardly from the centre of the grinding surface to thereby be positioned on the grinding surface at a distance from the centre such that the generally conical grinding member crushes the granular material in its precessive motion around the grinding surface.

Embodiments of the present invention willnow be described, by way of example with reference to the accompanying drawings, in which:-

Figure 1:
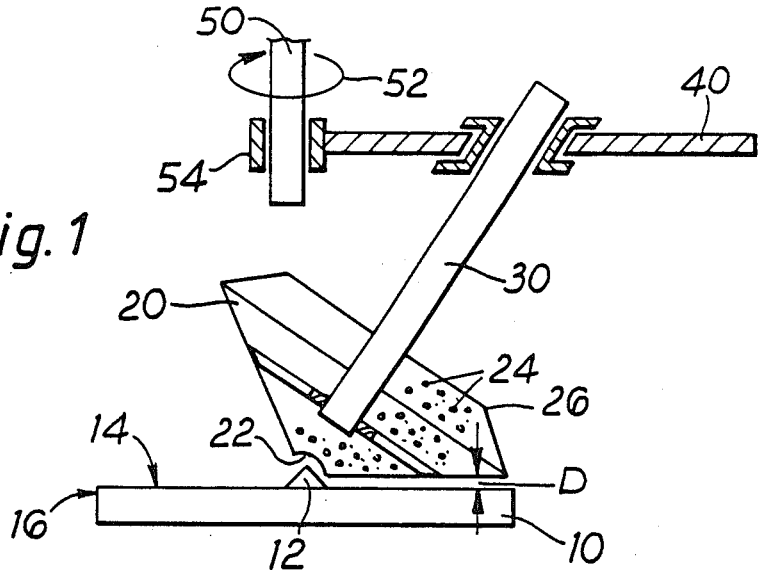
FIG. 1 shows schematically a first embodiment of a grinding mill according to the present invention.

With reference now to FIG. 1 of the drawings the grinding mill includes two basic members a circular grinding "stone" 10 and a conical grinding member 20. An apparatus for providing the movement of the conical grinding member 20 relative to the circular grinding surface provided by the stone 10 is described in our copending U.S. Patent Application No. 930,370, the description of which is hereby incorporated. The grinding surface is provided with a central conical shaped pip 12. The member 20 is frusto-conical having a hole 22 which is positioned to correspond with the pip 12.

The member 20 is "rolled" round the upper surface 14 of the grinding surface 10 by a drive arrangement 30, 40, 50 comprising an axle for the cone a drive arm and a central drive spindle. Rotation of the central drive spindle 50 in the direction of arrow 52 causes the conical grinding member 20 to roll in an anticlockwise direction.

Material 24, for example wheat grain, to be ground is fed into the centre of the cone 20 and is prevented from falling out by a rim 26. The material 24 may be fed by any suitable means at a required rate preferably proportional to the rotational speed of cone 20. The grinding stone 10 remains stationary and the material 24 falls out of hole 22 onto the surface of the stone 10 near to the pip 12 and is then ground by the cone 20 as it rolls round the upper surface 14 moving steadily outwards towards rim 16 to be collected by any convenient means (not shown). the gap D may be adjusted by adjustment of for example linear bearing 54 on shaft 50.

Figure 2:
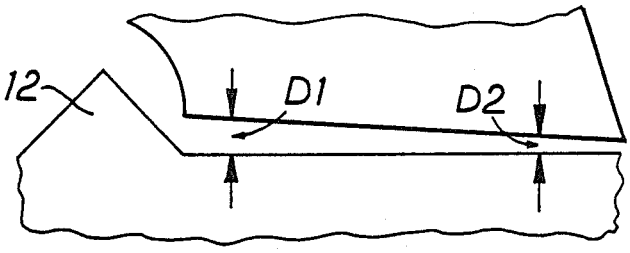
FIG. 2 shows diagrammatically in cross-sectional elevation a portion of the grinding mill of FIG. 1 illustrating a second embodiment.

With reference to FIG. 2 in a second embodiment, by suitable design of the conical surface the gap D1 nearest to pip 12 is made greatger than the gap D1 thereby providing a progressive grinding of the material 24.

Figure 3:
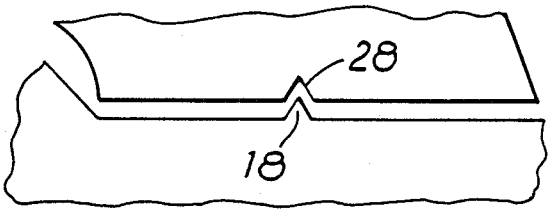
FIG. 3 shows diagrammatically a portion of the grinding mill of FIG. 1 illustrating a third embodiment.

With reference to FIG. 3 in a third embodiment the surface 14 of stone 10 may be provided with a circular ridge or ridges 18. The ridges 18 assist in holding the granular material on the surface 14 and grind it down to a smaller size. Co-operating furrows 28 are provided on the conical grinding member 20.

The surface 14 may be angled downwards as shown in dotted outline which in combination with ridges 18 give good grinding and also assists in movement of the ground material towards the edge 16.

Figure 4:
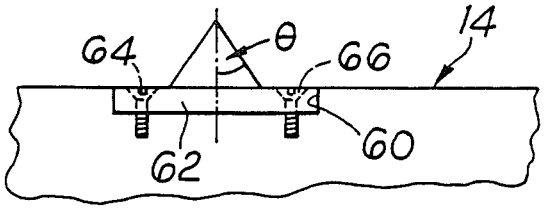
FIG. 4 shows diagrammatically a portion of the grinding mill of FIG. 1 illustrating a fourth embodiment.

With reference now to FIG. 4 the pip 12 may be made removable by providing a recess 60 in the grinding surface 14 and mounting within the recess a plate 62 held by screws 64, 66. The plate 62 has integrally formed therewith a pip with a defined angle $\theta$ of, for example 45° The plate can however be readily replaced by a substitute plate with a pip of different size having, for example, an angle $\theta$ of 60°. Thus the angle $\theta$ can be adjusted to suit different material being ground.

I claim:

1. A mill for grinding granular material comprising:

a grinding surface;

a generally conical grinding member having a hollow therein;

a mounting arrangement for supporting the generally conical grinding member in such a manner that the grinding member can be precessed around the grinding surface, the mounting arrangement including feed means for introducing the granular material into the hollow of the grinding member, in which the apex of the generally conical grinding member is cut away to produce a hole through the grinding member connecting to the hollow therein, in which the grinding surface is provided with an upstanding pip positioned centrally,in which the mounting arrangement for supporting the generally conical grinding member comprises means for locating the generally conical grinding member in a defined position relative to the grinding surface in such a manner that the upstanding pip co-operates with the hole through the apex of the generally conical grinding member in such a manner as to partially block gthe hole and prevent the passge of the granular material through a first portion of the hole whilst allowing passage of the granular material through a second portion of the hole, in which the granular material passing through the second portion of the hole is deflected by the upstanding pip on the grinding surface outwardly from the centre of the grinding surface to thereby be positioned on the grinding surface at a distance from the centre such that the generally conical grinding member crushes the granular material in its precessive motion around the grinding surface.

2. A mill for grinding granular material as claimed in claim 1 in which the grinding surface is stationary.

3. A mill for grinding granular material as claimed in claim 1 in which tghe means for locating the generally conical member is dimensioned such that a variable gap is present between the generally conical grinding member and the grinding surface, the variable gap being wedge shaped and decreasing in width outwardly from the upstanding pip.

4. A mill for grinding granular material as claimed in claim 1 in which the grinding surface is provided with an upstanding circular ridge and in which the generally conical grinding member is provided with a co-operating furrow.

5. A mill for grinding granular material as claimed in claim 4 in which the grinding surface is angled downwards away from the upstanding pip.

6. A mill for grinding granular material as claimed in claim 1 in which the grinding surface is formed with a central recess in which a plate holding the upstanding pip is secured.

7. A mill for grinding granular material as claimed in claim 6 in which the upstanding pip is cone shaped and in which the angle of the cone is selected to suit the granular material to be ground.

* * * * *